United States Patent [19]

Mellinger

[11] 4,042,089

[45] Aug. 16, 1977

[54] COIN SLIDE APPARATUS

[75] Inventor: John C. Mellinger, Newton, Iowa

[73] Assignee: The Maytag Company, Newton, Iowa

[21] Appl. No.: 703,929

[22] Filed: July 9, 1976

[51] Int. Cl.[2] ..... G07F 3/02

[52] U.S. Cl. ..... 194/102; 194/97 A

[58] Field of Search ..... 194/92, 93, 1 G, DIG. 2, 194/55-60, 78-82, 99, 2, 102, 97 B, 97

[56] References Cited

U.S. PATENT DOCUMENTS 3,498,438 3/1970 Arzig ..... 194/102

*Primary Examiner*—Stanley H. Tollberg

*Attorney, Agent, or Firm*—Richard L. Ward

[57] ABSTRACT

A coin slide apparatus which includes a housing for mounting the apparatus to a machine, a coin slide assembly, and a guideway in the housing for the coin slide assembly to operate within. The coin slide assembly is reciprocally operable in the guideway from an extended coin receiving position through coin measuring and coin ejection positions to a position for initiating operation of the machine. The movable slide assembly comprises two main members: an upper slide plate and a center slide plate. The upper slide plate is formed to include the operating handle at one end and has coin receiving slots of a predetermined size. The center slide plate has downwardly projecting fingerlike members defining between them coin pockets subjacent the slots in the upper slide plate for supporting coins on edge and further defining coin pushers. The center slide plate also serves as a storage area for blanking members which are used to convert the apparatus from one combination of coins to another. Coin sensing levers are pivotally mounted alongside gaging blocks and extend upward to engage with tracks in the center slide plate. The coin sensing levers are biased toward the coin measuring area.

Proper coins are vertically supported on the gaging blocks with the upper edge of the coin face engaging a shoulder portion of the coin pockets in the center slide plate. Improper coins are not supported between the gaging blocks and the shoulders but are pivoted sideways by the coin sensing levers which then cooperate with stops in the tracks of the center slide plate to prevent operation of the coin slide assembly.

15 Claims, 4 Drawing Figures

COIN SLIDE APPARATUS

BACKGROUND OF THE INVENTION

1. Field of the Invention

This invention relates to the field of coin actuated machines and more particularly to a coin slide apparatus therefor.

2. Description of the Prior Art

Prior coin slide art shows a continuing search for a coin slide apparatus operable for verifying coins of several denominations. U.S. Pat. No. 3,712,440, for example, has provisions for carrying a plurality of coins supported vertically on edge in a single transverse row across the slide and utilizes a V-groove for supporting the bottom portion of a coin and a pivotal arm engageable with the edge of the coin and movable by the coin. In this prior art disclosure the pivotal arm simply engages with the slide assembly, if the arm is not moved sufficiently by the coin, to prevent further inward movement of the assembly. In U.S. Pat. Nos. 3,137,378; 3,338,366 and 3,354,998 the coins are inserted in a horizontal plane and a V-groove is utilized for gaging the diameter. These prior art systems teach gaging across the diameter of the coin to move a lever or other mechanism out of engagement with the slide mechanism if the loading across the diameter is sufficient.

SUMMARY OF THE INVENTION

It is an object of the instant invention to provide an improved movable coin slide assembly for a coin slide apparatus.

It is a further object of the instant invention to provide a unique system of verifying vertically oriented coins.

It is a still further object of the instant invention to provide a novel method of supporting coins as they are being verified.

It is a further object of the instant invention to utilize a system of sideways biased coin sensing levers engageable with the face of the coins to provide a side load for deflecting spurious coins from an upright position and to effect engagement of coin sensing levers with stops in the slide assembly.

Briefly, the instant invention achieves these objects in a coin slide apparatus that includes a housing and associated mounting means combined with a coin slide assembly and various coin measuring devices. In the disclosed apparatus coins exceeding a maximum size are not admitted to the coin measuring area and coins of less than a minimum size will not be supported in the coin measuring area but will be biased by coin sensing levers from a vertical orientation to a position where the coin sensing levers will engage with stops in the slide assembly to halt further advancement of the slide assembly.

Operation of the apparatus and further objects and advantages thereof will become evident as the description proceeds and from an examination of the accompanying two pages of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
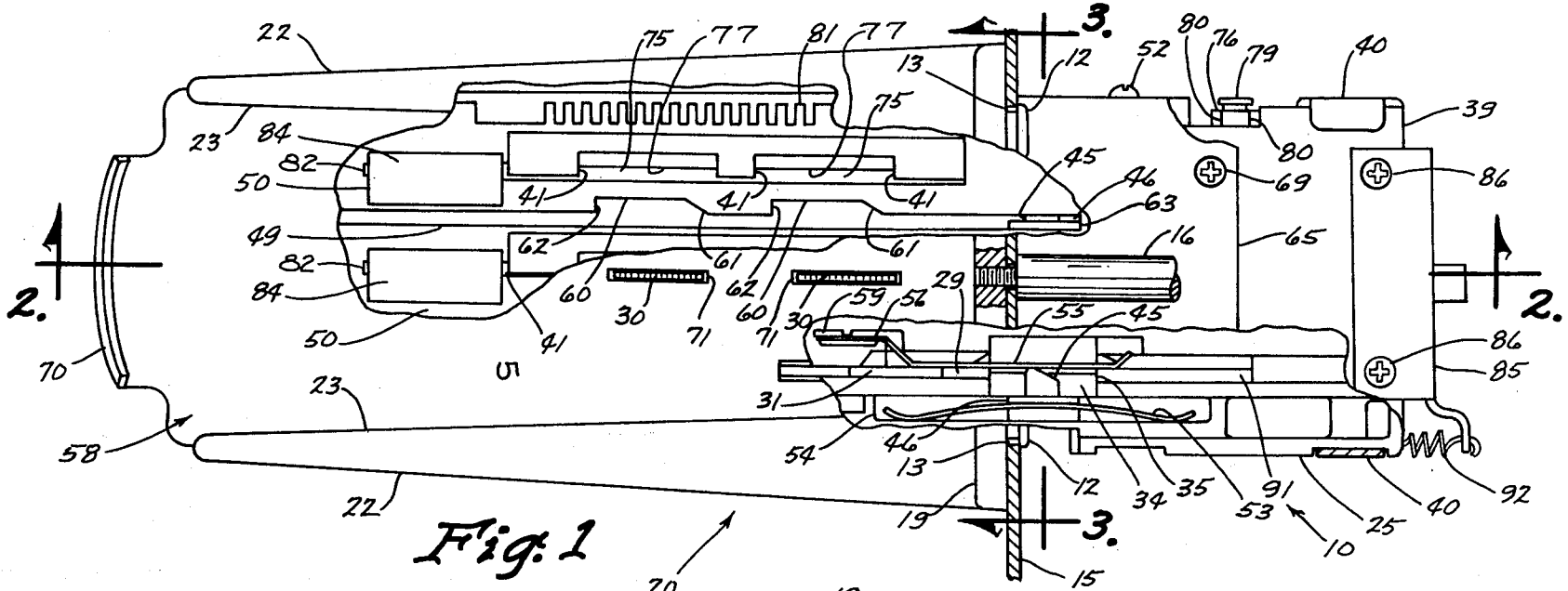
FIG. 1 is a plan view of the coin slide apparatus with a portion broken away to show the ratchet teeth, the blanking members in storage and other interior details.

Referring to the drawings there is shown generally in FIG. 1 and further in the additional drawings a coin slide apparatus 10 so constructed as to be mounted in a standard coin slide vault panel opening 11 and supported on a machine which is to be actuated by such a coin slide apparatus 10.

Figure 2:
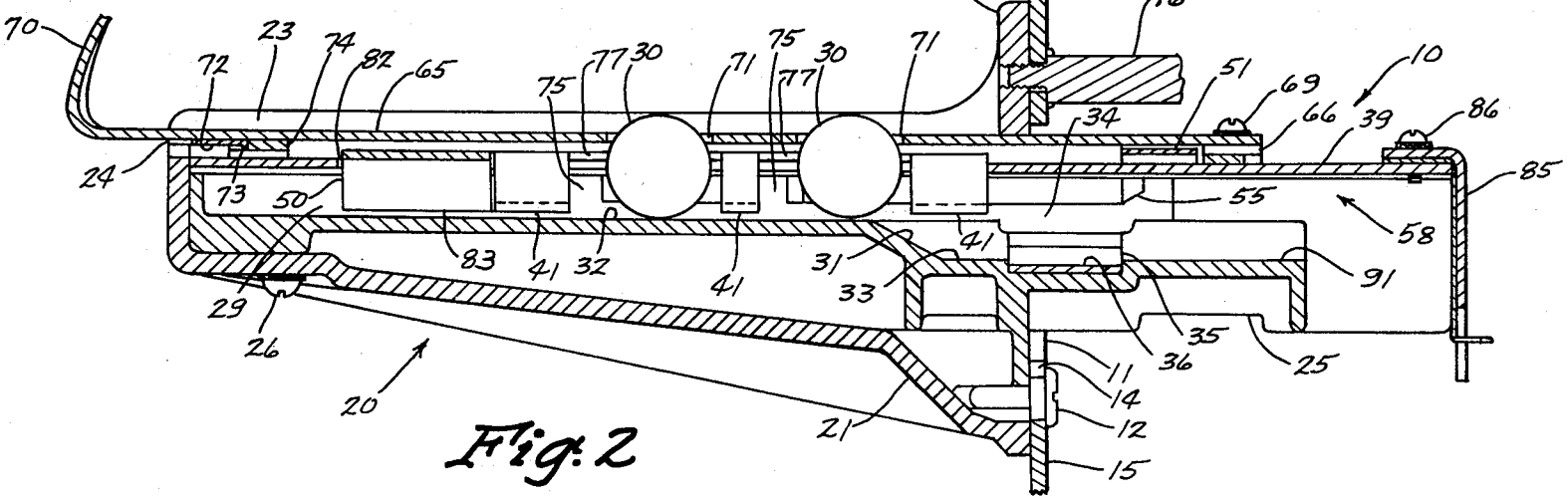
FIG. 2 is a sectional view taken along lines 2—2 of FIG. 1, showing interior construction detail along a coin slot.
Figure 4:
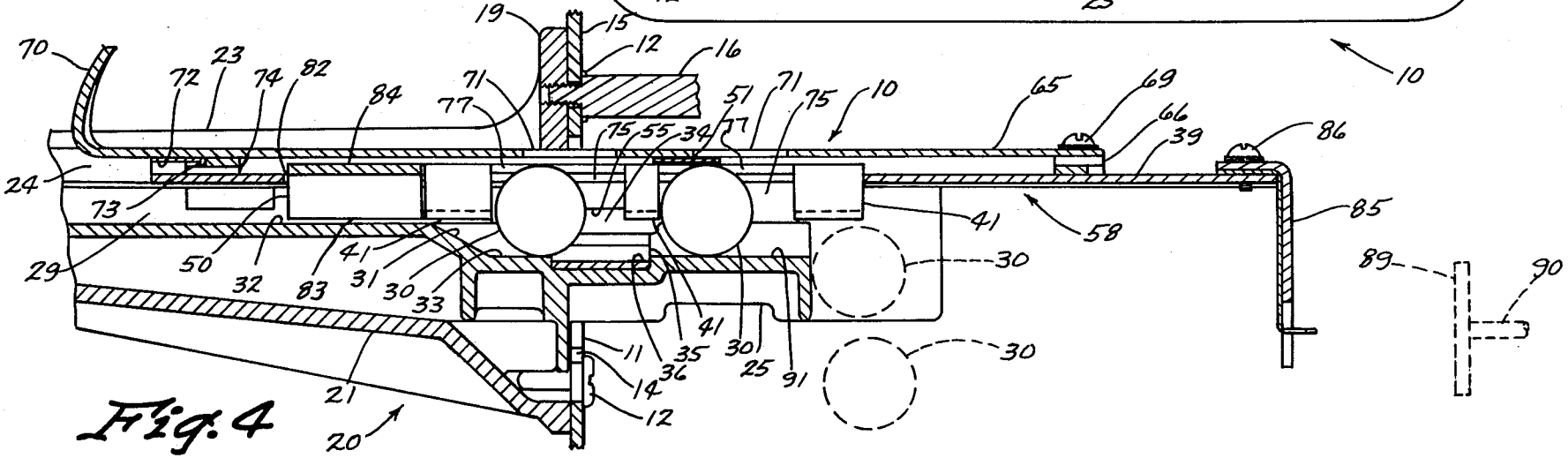
FIG. 4 is a view similar to FIG. 2 showing coins being advanced through the coin ejection position and leaving the coin slide.

Referring to FIGS. 1, 2 and 4, the coin slide apparatus 10 is mounted in a standard opening 11 cut into the front panel of the coin slide vault. This mounting is accomplished by sliding the apparatus 10 into the opening, toward the right in FIGS. 1, 2 and 4, and allowing the shouldered screws 12 to pass through clearance holes 13 at the top and clearance slots 14 at the bottom of the opening 11 and then shifting the apparatus 10 to permit the shoulders of the screws 12 to grip the vault wall 15. Final securing of the apparatus 10 is accomplished within the vault by tightening a threaded rod 16 into the faceplate 19 which draws the apparatus 10 snugly against the vault wall 15.

The coin slide apparatus 10 includes a faceplate 19 and a forwardly extending slide support housing 20 which are cast as a unitary member. The forwardly extending slide support housing 20 includes a base 21 and a pair of opposed sidewalls 22 having inwardly extending flanges 23 as shown in FIG. 1, to define a rearwardly extending longitudinal channel 24 through the faceplate 19.

Assembled into the longitudinal channel 24 from the rear of the faceplate 19 is a coin slide body 25, as shown in FIG. 2. The coin slide body 25 is connected to the combination faceplate-slide support housing 19 and 20 by a trio of threaded fasteners 26 as shown in FIGS. 2 and 3.

The coin slide body 25 includes three longitudinally extending coin slots or grooves 29. As shown in FIG. 2, these slots 29 have sufficient depth to support a coin 30 vertically on edge and extend rearward toward a downward sloping ramp 31. This ramp 31 is utilized to lower the coins 30 from the ccoin receiving elevation 32 to the coin measuring elevation 33 and also to enable the coins 30 to pass beneath the faceplate 19.

Figure 3:
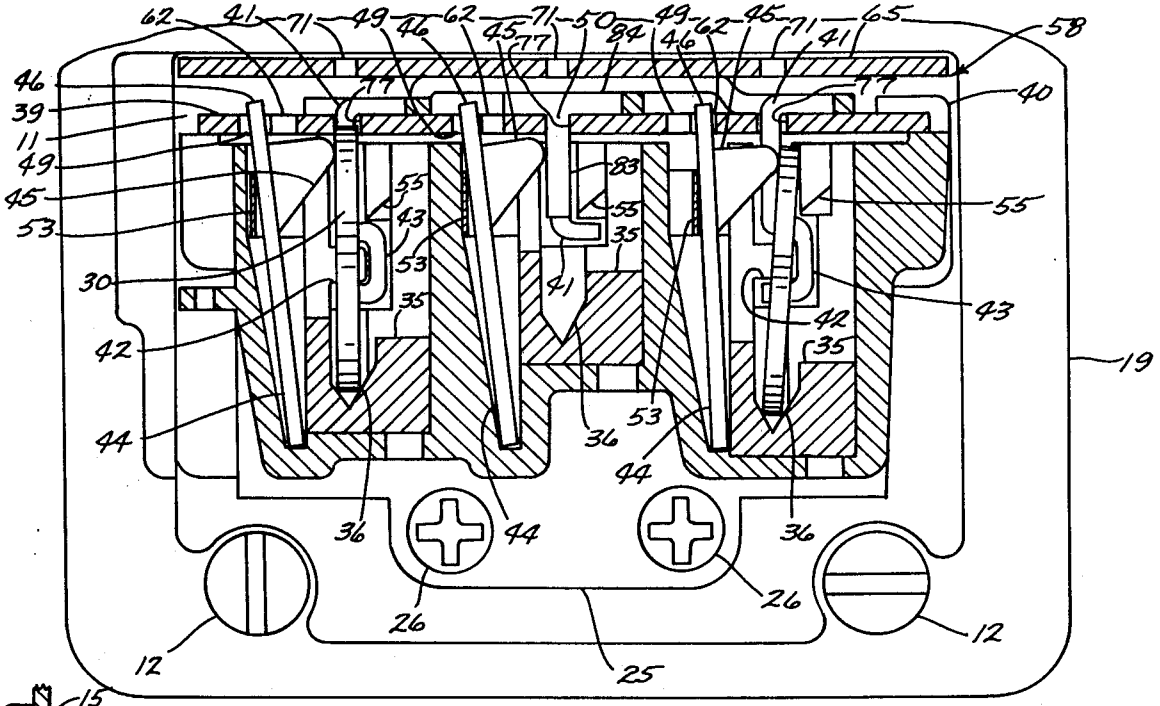
FIG. 3 is a sectional view in an enlarged scale taken generally along lines 3—3 of FIG. 1.

Referring now to FIG. 3, it can be seen that provisions have been made to pass three coins of varying denominations through the coin measuring area 34 at one time. Beginning at the left in FIG. 3, this particular coin slide is adapted to receive and verify a nickel, a dime and a quarter. Referring to FIGS. 2 and 4 in particular it can be seen that the coin measuring area 34 is just rearward of the downward sloping ramp 31.

Located in the measuring area 34 as shown in FIGS. 2 and 3 are three hardened gaging blocks 35. These gaging blocks 35 are generally rectangular in shape and are pressed into mating cavities in the coin slide body 25 at different elevations for different denomination coins. The gaging blocks 35 are identical for all denominations of coins with the difference in cavity elevations providing the proper vertical spacing. These gaging blocks 35 each have a V-shaped groove 36 running longitudinally so that the lower edge of the coin 30 rides in the V-groove as the coin 30 is verified.

Again referring to FIGS. 2 and 3, a center slide plate 39 rides on top of the coin slide body 25. This center slide plate 39 is prevented from moving sideways by a plurality of brackets 40 secured to th coin slide body 25 such as at the rear end in FIG. 1 and upper right in FIG. 3. Vertical movement of the center slide plate 39 is prevented by the intermeshing of downwardly extending fingers or coin pushers 41 with rectangular rib portions 42 of two of the longitudinal grooves 29 in the coin slide body 25. Two of the downwardly extending fingers 41 have a lower portion horizontally offset at generally 90 degrees for a short distance and then extending downward a distance slightly greater than the height of the rib 42 and back horizontally parallel with the first offset to form a hook 43 for meshing with the ribs 42. The center finger 41 has a short horizontal leg which simply travels in the center groove 29 for pushing the coins 30. The meshing of the ribs 42 and hooks 43 also serve to guide the center slide plate 39 during longitudinal reciprocation.

FIG. 3 shows coin sensing levers 44 mounted generally vertically in the coin slide body 25 juxtaposed the gaging blocks 35. These coin sensing levers 44 are generally rectangular in cross section and have a triangular projection 45 located approximtely three-quarters up from the lower end. The upper end 46 of the coin sensing lever 44 projects through the center slide plate 39 and rides in a track 49 as shown in FIGS. 1 and 3 which will be explained further hereinbelow. As further shown in FIG. 3, the triangular projection 45 of the coin sensing lever 44 contacts either the coin 30 or a blanking member 50.

Located just forward of the coin measuring area 34 and directly above the center slide plate 39 is a tape stripper bar 51. This tape stripper bar 51 is formed from sheet metal and is secured to the coin slide body 25 by two screws 52 as shown in FIG. 1. This tape stripper bar 51 will sever a piece of tape that has been fastened to a coin 30 for the improper purpose of retrieving the coin 30 after the machine has been actuated.

As shown in FIGS. 1 and 3, a leaf spring 53 is located behind or to the left of each of the coin sensing levers 44. These leaf springs 53 bias the levers 44 toward the gaging blocks 35 and the coin measuring area 34 and are mounted in generally rectangular openings 54 in the coin slide body 25. The leaf springs 53 are arcuately shaped with the arcuate portion toward the coin sensing lever 44.

As shown in FIGS. 1, 2 and 3, a cantilevered spring 55 is mounted alongside the coin measuring area 34 opposite each of the coin sensing levers 44. The anchored end 56 of this spring 55 extends forward alongside the coin measuring area 34 and is captured in a slot arrangement 59 as shown in FIG. 1. The purpose of the spring 55 is to bias an improper coin back toward the original vertical position so that it may be returned to the coin receiving area 32.

Referring to FIGS. 1 and 3, the upper portion 46 of the coin sensing levers 44 project through the center slide plate 39 and ride in tracks 49. These tracks 49 run longitudinally along the center slide plate 39 and include a stop 60 adjacent each coin position. The stops 60 are shaped with a tapered camlike entrance-exit 61 and an abutment 62 at the opposite end. When the coin slide assembly 58 is advanced without coins or with improper coins the coin sensing levers 44 will be biased toward the stops 60 and will contact the abutment 62. When returned to the coin receiving position the coin sensing levers 44 will follow the tapered entrance-exit 61 to return to a generally vertical position as shown in FIG. 3. These tracks 49 serve a second purpose since the ends 63 serve as stops to limit inward and outward movement of the center slide plate 39.

Completing the slide assembly 58 is an upper slide plate 65 which is fixed to a mounting bracket 66 on the center slide plate by a pair of fasteners 69. The upper slide plate 65 also includes an upturned handle 70, at the end opposite the fasteners 69, for operation of the slide asembly 58 within the guideway defined by the inwardly extending flanges 23 of the slide support housing 20. The upper slide plate 65 includes two transverse rows of coin slots 71 which are sized to receive coins 30 of particular denominations including two slots 71 for quarters one behind the other, two slots 71 for dimes one behind the other and one slot 71 for a nickel. The slots 71 in the upper slide plate 65 are aligned between the downwardly extending fingers 41 of the center slide plate 39. Though five slots 71 are provided for in the upper slide plate 65, means are provided for blanking off up to four slots 71 as will be shown and discussed hereinbelow.

The coin slots 71 perform a preliminary measuring of a coin's width and thickness. The upper slide plate 65 also includes a stop member 72 as shown in FIGS. 2 and 4. This stop member 72 is a sheet metal piece with a downturned lip 73 which is secured to the underside of the upper slide plate 65 and rests in a bracket 74 fastened to the front of the center slide plate 39. When the slide assembly 58 is operated, the stop member 72 and bracket 74 combination serve to transmit the operational impact force from the handle 70 and upper slide plate 65 to the center slide plate 39 which prevents the application of undue force on the fasteners 69 that connect the upper slide plate 65 to the center slide plate 39.

As shown in FIG. 2, the center slide plate 39 in combination with the coin slide body 25 provides substantial thickness to the slide assembly 58 as compared to the thickness of the upper slide plate 65, and thus a significant portion of the coin diameter is below the surface of the upper slide plate 65 when the coin 30 is of proper diameter. The center slide plate 39 portion includes two transverse rows of coin receiving pockets 75, with ends being defined by the downwardly extending fingers 41, below and substantially aligned with the slots 71 in the upper slide plate 65 but these coin receiving pockets 75 are of uniform size rather than of a size that corresponds to the size of the juxtaposed slot 71 in the upper slide plate 65.

The coin slide body 25 mounts a ratchet mechanism, as shown in FIG. 1, where a ratchet pawl 76 is pivotally mounted on a stud 79 pressed into the coin slide body 25. The ratchet pawl 76 is a hardened metal part having a center pivot with a generally rectangular shape at one end defining two sharp edges 80 for engagement with ratchet teeth 81 on the center slide plate 39 on either the forward or return stroke of the slide assembly 58 and a tapered opposite end (not shown) for attaching a pawl biasing member (not shown). The toothed portion 81 of the ratchet mechanism is formed in one side of the center slide plate 39 as shown in FIG. 1 and is operable for engagement with the ratchet pawl 76. Once the coins 30 pass through the coin measuring area 34, the ratchet pawl 76 engages with a ratchet tooth 81, thus requiring the slide assembly 58 to be advanced past the remaining ratchet teeth 81. Once the slide assembly 58 and ratchet pawl 76 have been advanced past the ratchet teeth 81 to the operative position, the ratchet pawl 76 will reverse and the ratchet teeth 81 will engage in the reverse direction during withdrawal of the slide assembly 58 so that the slide asembly 58 cannot be returned to the operative position before returning to the coin receiving position. The ratchet mechanism thus functions to require a complete slide assembly 58 reciprocation once an actuation has been effected so that the coins 30 cannot be returned rather than being ejected into a coin receptacle within the vault.

As previously indicated, up to four of the five coin slot 71 may be blocked off so that the indicated coin 30 is not required and in fact cannot be inserted into the coin slot 71 of the upper slide plate 65. Stored within the third center slide plate pockets or recesses 82, as shown in FIGS. 1, 2 and 4, are blanking members 50 which are fabricated from a nonmagnetic material and have a general T-shaped cross section with a downwardly projecting leg 83 for engaging with the triangular projection 45 of the coin sensing levers 44, as if it were a coin, to prevent the lever 44 from engaging with the stop abutment 62.

To remove the upper slide plate 65 for conversion of the coin slide apparatus 10 from one combination of coins 30 to another, the two mounting fasteners 69 are removed and the upper slide plate 65 may be removed by sliding it forward through the faceplate 19 and away from the center slide plate 39 of the slide assembly 58 to expose the blanking members 50 disposed in the third row of pockets 82 without disassembly of other parts. Blanking members 50 may then be removed from the third row of storage pockets or recesses 82 and placed in the first or second coin receiving pockets 75 so that the top portion 84 will underlie the coin slot 71 in the upper slide plate 65 and the leg portion 83 will extend downwardly to the position juxtaposed the coin sensing levers 44. The coin receiving slots 71 may be selectively blocked off so that the slide assembly 58 may be adapted to receive and actuate at any 5-cent increment between a coin value of 5 cents to 75 cents. When the blanking member 50 is in a slot blanking posiiton, a coin 30 cannot be inserted into the coin slot 71 of the upper slide plate 65, and as the slide assembly 58 is advanced to he coin measuring area 34, the leg portion 83 operates to engage the triangular projection 45 of the coin sensing lever 44 to prevent it from engaging the stop 60 in the center slide plate 39 to thus obviate the need for a coin 30 in that particular slot 71.

As shown in FIGS. 1, 2 and 4, an actuator bracket 85, which is operable for actuating the timer or other control device to initiate operation of the machine, is attached to the center slide plate 39 by a pair of threaded members 86. FIG. 4 also shows in dashed lines a bumper 89 mounted on th control shaft 90 of the timer.

For purposes of discussing operation of the coin slide apparatus 10 with either proper coins 30, blanking members 50 or with improper coins, refer generally to FIGS. 2, 3 and 4. FIGS. 2 and 4 show proper coins 30 advancing and being ejected. All coins 30 with the exception of the single nickel position are advanced in tandem or one behind the other as shown in FIGS. 2 and 4. As these coins 30 are advanced in tandem, the first coin 30 will not be ejected until the second coin 30 has been verified but will be held in escrow on a shelf portion 91 of the coin slide body 25 just to the rear of the gaging block 35. In a like manner the ratchet pawl 76 will not engage the ratchet teeth 81 on the center slide plate 39 until the second coin 30 has been verified so that the slide assembly 58 may be retracted if one of the second coins 30 is improper.

After the preliminary measurement for maximum thickness and diameter at the upper slide plate 65, the criterion of validity is the effective height of the coin 30 which is determined by both thickness and actual diameter. As the coins 30 ride in the V-groove 36 of the gaging blocks 35, a thin coin will ride low in the V-groove 36 and may not be supported by the upper shoulder portion 77 of the pocket 75 in the center slide plate 39.

The left slot, or nickel slot, in FIG. 3 shows a proper coin 30 in the coin measuring area 34. This coin 30 has sufficient height or diameter and thickness to engage the shoulder portion 77 of the coin pocket 75 of the center slide plate 39. The triangular projection 45 of the coin sensing lever 44 rides against the coin 30 but because the upper portion of the coin 30 is supported by the coin pocket shoulder 77, the lever 44 cannot pivot to the right and thus it will remain in the track 49 without engaging the stop 60 to allow the slide assembly 58 to continue to the operational position where the actuator bracket 85 engages and effects operation of a timer or the like.

The center coin pocket 75 as shown in FIG. 3 is occupied by a coin blanking member 50. The blanking member 50 in effect duplicates the coin function so that as the triangular projection 45 of the coin sensing lever 44 contacts the leg portion 83 of the blanking member 50 it is prevented from contacting the abutment 62 associated with the stop 60 in the track 49 of the center slide plate 39.

FIG. 3 shows in the right-hand, or quarter slot, an improper coin. This coin is either too thin, too small in diameter, or both, so that the upper edge cannot engage with the shoulder portion 77 of the coin pocket 75. Since the upper edge of the coin is not supported, the spring biased coin sensing lever 44 will move the upper part of the coin to the right and the upper portion 46 of the coin sensing lever 44 will contact the abutment portion 62 of the stop 60 in the center slide plate track 49 to prevent advancement of the slide asembly 58 to the operative position. When the slide assembly 58 is returned to the coin receiving position, the cantilevered spring 55 on the right side of the coin will bias the coin to an upright position and the coin sensing lever 44 will be cammed to its original position by the tapered entrance-exit portion 61 of the stop 60 so that the coin and slide assembly 58 may be withdrawn.

The herein described method of verifying coins may also be utilized in other coin slide apparatus such as shown in Ser. Nos. 633,447 and 633,448 filed Nov. 19, 1975 and entitled "Coin Authenticating Slide Mechanism" and "Coin Slide Assembly" respectively and assigned to the assignee of the instant invention.

When the slide assembly 58 has reached the operative position, it is prevented from further travel by the engagement of the coin sensing levers 44 with the end 63 of the tracks 49. Upon completion of the inward actuation stroke of the slide assembly 58, the slide assembly 58 is returned to the coin receiving position by a return spring 92 that is mounted between the side of the actuator bracket 85 and the coin slide body 25 as shown in FIG. 1. The return stroke is limited by the engagement of the coin sensing levers 44 with the opposite ends 63 of the tracks 49.

If actuation of the coin slide apparatus 10 is attempted without the presence of a coin 30 in any of the required positions, the coin sensing lever 44 will simply be biased to the right to engage the abutment 62 of the stop 60 in the appropriate tract 49 and prevent further advancement of the slide assembly 58.

The invention of the instant application is also disclosed in the application entitled "Tandem-Coin Slide Apparatus" filed on an even date herewith by John C. Mellinger and assigned to the assignee of this application.

The present coin slide apparatus thus provides an improved apparatus offering a simple, reliable method of verifying coins 30 by utilizing coin sensing levers 44 to apply side loading to coins 30 which are substantially vertically supported between V-grooved gaging blocks 35 in the slide body 25 and shoulders 77 in the slide assembly 58. The coins 30 are gaged for maximum thickness and diameter by the coin slots 71 in the upper slide plate 65 at the coin receiving position. When the coins 30 reach the measuring area 34, the diameter and thickness determine the apparent height so that a go or no-go situation is encountered. The coins 30 will either pass through the coin measuring area 34 if the apparent height is sufficient for the upper portion of the coin faces to contact the shoulders 77 in the slide assembly 58 or they will not be high enough to contact the shoulders 77 and will be deflected sideways by the coin sensing levers 44.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. A coin slide apparatus for initiating the operation of a machine with a predetermined combination of coins supported substantially on edge, comprising: slide support means for mounting said coin slide apparatus to said machine including a faceplate and a slide housing defining a coin slide guideway extending through said faceplate; coin receiver means supported in said slide housing and defining a plurality of longitudinal grooves and a plurality of coin slots for receiving said coins and upon manual actuation for moving said coins from a coin receiving position to a coin measuring position; coin measuring means associated with each of said grooves and including a gaging block for supporting the lower edge of said coin and a shoulder spaced a predetermined distance above said gaging block and engageable by the face of said coin at the upper edge thereof; a coin sensing lever adjacent said groove at said coin measuring position and biased against said coin on the side opposite said shoulder and having a first posture with a proper sized coin engaging said shoulder and movable to a second posture with an undersized coin in said groove; and stop means engageable by said coin sensing lever in said second posture to prevent the advancement of said coin slide assembly from said coin measuring position to an actuating position.

2. A coin slide apparatus as defined in claim 1 wherein said coin receiver means includes a coin slide body defining said plurality of longitudinal grooves, an upper slide plate defining said plurality of coin slots and a center slide plate movable with said upper slide plate.

3. A coin slide apparatus as defined in claim 2 wherein said center slide plate includes said shoulder for engaging with said face of said coin.

4. A coin slide apparatus as defined in claim 1 wherein one of said gaging blocks and said shoulder is fixed with respect to said slide housing at said coin measuring position.

5. A coin slide apparatus for initiating the operation of a machine with a predetermined combination of coins supported on edge, comprising: slide support means for mounting said coin slide apparatus to said machine including a faceplate and a slide housing defining a coin slide guideway extending through said faceplate; a coin slide assembly supported in said slide housing and having a portion reciprocally movable in said guideway, said coin slide assembly including a coin slide body defining a plurality of longitudinal grooves and slide plate means having a plurality of coin slots above and generally aligned with said grooves for receiving said coins and being reciprocally movable in said guideway for urging said coins along said longitudinal grooves; coin measuring means associated with each of said grooves and including a gaging block generally aligned with said groove for supporting the lower edge of said coin, said coin measuring means further including a shoulder on said slide plate means spaced a predetermined distance above said gaging block and engageable by the face of said coin at the upper edge thereof; a coin sensing lever adjacent said groove and biased against said coin on the side opposite said shoulder and having a first posture with a proper sized coin engaging said shoulder and movable to a second posture with an undersized coin in said groove; and stop means engageable by said coin sensing lever in said second posture to prevent operation of said coin slide assembly to an operative position .

6. A coin slide apparatus as defined in claim 5 wherein said slide plate means includes an upper slide plate having said plurality of coin slots and further includes a center slide plate movable with said upper slide plate and having coin pockets generally aligned below said coin slots.

7. A coin slide apparatus as defined in claim 6 wherein said coin pockets in said center slide plate further define said shoulders.

8. A coin slide apparatus for initiating the operation of a machine with a predetermined combination of coins supported on edge, comprising: slide support means for mounting said coin slide apparatus to said machine including a faceplate and a slide housing defining a coin slide guideway extending through said faceplate; a coin slide assembly supported in said slide housing and having a portion reciprocally movable in said guideway, said coin slide assembly including a coin slide body defining a plurality of longitudinal grooves, an upper slide plate having a plurality of coin slots generally aligned above said grooves for receiving said coins and reciprocally movable in said guideway, and a center slide plate movable with said upper slide plate for urging said coins along said longitudinal grooves; coin measuring means associated with each of said grooves and including a gaging block generally aligned with said groove for supporting the lower edge of said coin, said coin measuring means further including a shoulder on said center slide plate spaced a predetermined distance above said gaging block and engageable by the face of said coin at the upper edge thereof; a coin sensing lever adjacent said groove and biased against said coin on the side opposite said shoulder and having a first posture with a proper sized coin engaging said shoulder and movable to a second posture with an undersized coin in said groove; and stop means engageable by said coin sensing lever in said second posture to prevent the advancement of said coin slide assembly to an operative position.

9. A coin slide apparatus as defined in claim 8 wherein said center slide plate includes a plurality of downwardly extending fingers for cooperating with said longitudinal grooves to guide said center slide plate during said reciprocal movement.

10. A coin slide apparatus as defined in cliam 9 wherein said downwardly extending fingers define between them a plurality of coin pockets.

11. A coin slide apparatus as defined in claim 8 wherein said gaging block is fixed to said coin slide body and includes a V-groove substantially aligned with said longitudinal groove for supporting said lower edge of said coin so that the apparent height of said coin is determined by both the thickness and diameter of said coin.

12. A coin slide apparatus as defined in claim 8 wherein said coin slots are of a predetermined length and width for effecting a preliminary measurement of each of said coins.

13. A coin slide apparatus as defined in claim 8 wherein said coin slide body includes tape stripper means for severing tape attached to said coins for retrieving said coins after measurement and prior to ejection.

14. A coin slide apparatus for initiating the operation of a machine with a predetermined combination of coins supported on edge and convertible from one actuating combination of coins to another, comprising: slide support means for mounting said coin slide apparatus to said machine inccluding a faceplate and a slide housing defining a coin slide guideway extending through said faceplate; a coin slide assembly supported in said slide housing and having a portion reciprocally movable in said guideway, said coin slide assembly including a coin slide body defining a plurality of longitudinal grooves, an uppr slide plate having a plurality of coin slots generally aligned above said grooves for receiving said coins and reciprocally movable in said guideway, and a center slide plate movable with said upper slide plate for urging said coins along said longitudinal grooves; coin slot blanking members storable in said slide assembly and selectively movable to pockets in said center slide plate generally below said coin slots in said upper slide plate for blanking one of said coin slots and obviating the requirement for a coin in said one coin slot; coin measuring means associated with each of said grooves including a gaging block having a V-groove generally aligned with said longitudinal groove for supporting the lower edge of said coin, said coin measuring means further including a shoulder on said center slide plate spaced a predetermined distance above said gaging block and engageable by the face of said coin at the upper edge thereof; a coin sensing lever adjacent said groove and biased against said coin on the side opposite said shoulder and having a first posture with a proper sized coin engaging said shoulder or with a blanking member in said pocket and movable to a second posture with an undersized coin in said groove; and stop means engageable by said coin sensing lever in said second posture to prevent the advancement of said coin slide assembly to an operative position.

15. A coin slide apparatus as defined claim 14 wherein said V-groove requires that the thickness and actual height of said coin will effect the apparent height of said coin as said coin extends upward toward said shoulder, the upper face of a too thin coin will not reach said shoulder and said coin will be moved sideways by said coin sensing levers thus preventing movement of said slide assembly to said operative position.

* * * * *